US005522983A

United States Patent [19]

Cash et al.

[11] Patent Number: 5,522,983

[45] Date of Patent: Jun. 4, 1996

[54] HYDROCARBON HYDROCONVERSION PROCESS

[75] Inventors: Dennis R. Cash, Novato; Robert W. Bachtel, El Cerrito, both of Calif.

[73] Assignee: Chevron Research and Technology Company, San Francisco, Calif.

[21] Appl. No.: 832,170

[22] Filed: Feb. 6, 1992

[51] Int. Cl.[6] ..... C10G 65/10

[52] U.S. Cl. ..... 208/59; 208/210; 208/217; 208/254 H

[58] Field of Search ..... 208/59, 211, 254 H, 208/210, 254

[56] References Cited

U.S. PATENT DOCUMENTS

| | | | |
|---|---|---|---|
| 3,461,061 | 8/1969 | Stine et al. | 208/58 |
| 3,607,723 | 9/1971 | Peck et al. | 208/59 |
| 3,673,078 | 6/1972 | Kirk, Jr. | 208/89 |
| 3,788,976 | 1/1974 | Kirk, Jr. | 208/89 |
| 3,843,508 | 10/1974 | Wilson et al. | 208/76 |
| 3,846,278 | 11/1974 | Sze et al. | 208/89 |
| 3,897,329 | 7/1975 | Franz et al. | 208/210 |
| 5,110,444 | 5/1992 | Haun et al. | 208/89 |

*Primary Examiner*—Helane Myers
*Attorney, Agent, or Firm*—V. J. Cavalieri

[57] ABSTRACT

A process is provided for converting a hydrocarbon feedstock comprising the steps of introducing the hydrocarbon feedstock to a first hydroconversion zone at superatmospheric pressure and at a temperature between about 450° F. and about 850° F. in the presence of hydrogen, the hydrogen flowing in a countercurrent relationship to the hydrocarbon feedstock, to form a hydrogen-rich vapor effluent and a hydrocarbon-rich liquid effluent; reacting the hydrogen-rich vapor effluent in a second hydroconversion zone to form a converted vapor effluent; and introducing a portion of the hydrocarbon-rich liquid effluent to the second hydroconversion zone in countercurrent relationship to the hydrogen-rich vapor effluent. By recycling to the second hydroconversion zone a stream having sufficiently high boiling range that it remains a liquid, a greater range of operating conditions are possible in the second hydroconversion zone, thus allowing for higher conversions and product yields.

12 Claims, 2 Drawing Sheets

HYDROCARBON HYDROCONVERSION PROCESS

BACKGROUND OF THE INVENTION

The present invention relates to a process for hydroconversion of hydrocarbon feedstocks which contain sulfur and nitrogen. More particularly it relates to a hydroconversion process utilizing multiple hydroconversion zones for reduced hydrogen, energy, and equipment costs.

The term "hydroconversion" is used here to connote a process in which hydrogen is reacted with a hydrocarbon on the surface of a heterogeneous hydroprocessing catalyst at process conditions. Example hydroconversion processes include hydrofining, hydrotreating and hydrocracking. The term "hydroconversion" is more particularly defined hereinbelow. The present invention is particularly directed to high pressure hydroconversion processes wherein the hydroconversion reaction zone is operated at a pressure above 500 psig.

In hydrofining, hydrotreating and hydrocracking reactions, an oil or other hydrocarbon feed is upgraded by chemical reactions carried out in the presence of hydrogen gas. Hydrofining is the mildest of these three types of hydroconversion processes. The term "hydrotreating" is generally applied to more severe hydroconversion processes than hydrofining, but often is used in a broad sense to include hydrofining. Typical hydrotreating reactions include desulfurization and denitrification of oil feeds. Heavy oil desulfurization is an important hydroconversion process and the process of the present invention is advantageously applied to such process. The term "hydrocracking" is generally used for more severe processes wherein more cracking of the oil feed occurs. However, there is not a sharp dividing line between these three types of hydroconversion processes. All three of these types of processes are well known and described in the literature, see, for example, Kirk-Othmer, Encyclopedia of Chemical Technology, Third Edition, Vol. 17, pages 201–206 and Vol 3, page 335.

The principal chemical reactions that occur in hydroconversion processes are cracking, hydrogenation, denitrification, desulfurization, demetalation and isomerization. These reactions are typically carried out by contacting a mixture of hydrogen and the feed hydrocarbons with a catalyst contained in one or more reactors at temperatures of 400° F. to 850° F. and pressures of 500 to 5,000 psig. The effluent from the hydroconversion reactor comprises unreacted hydrogen, converted and unconverted hydrocarbon materials (mainly hydrocarbons but often also small amounts of organic sulfur and/or nitrogen compounds), and product gases. The product gases include light hydrocarbons and contaminant gases, such as $H_2S$ and $NH_3$, generally produced by the hydrogenation of sulfur- and nitrogen-containing hydrocarbons.

In conventional hydroconversion processes, a combined feedstock comprising a hydrocarbon stream and hydrogen is caused to flow through a catalytic hydroconversion reaction zone in a downflow direction (see, for example, FIG. 10 of Kirk-Othmer, Encyclopedia of Chemical Technology, Third Edition, Vol. 17, p. 201). During such conventional processing, the reactions occurring near the top of the reaction zone are those reactions having a high reaction rate at the conditions in the reaction zone. When sulfur is present in the feed, hydrogen sulfide is generated relatively rapidly by the hydroconversion reactions. As the feedstock moves down through the zone, the hydrogen available for reaction becomes diluted with the hydrogen sulfide, ammonia and with the light gases generated by reaction. At the same time, the catalysts in the hydroconversion zone have reduced activity due to the presence of hydrogen sulfide and ammonia and are progressively contaminated through the hydroconversion zone. Consequently, using conventional processes, the more difficult reactions occur under conditions of lower catalyst activity and with lower available hydrogen purity.

The problems of the conventional processing are partially overcome by operating the reaction zone under conditions of countercurrent flow, as, for example, by introducing the liquid hydrocarbon feed to flow downward through the reaction zone, and introducing the hydrogen feed to flow upward through the same zone. P. Trambouze, "Countercurrent Two-Phase Flow Fixed Bed Catalytic Reactions," *Chemical Engineering Science*, Vol 45, No. 8, pp 2269–2275, 1990 describes such a countercurrent operation, lists commercial applications of the technology, and discusses the theoretical implications of this mode of operation.

U.S. Pat. No. 3,788,976, issued Jan. 29, 1974 to Kirk teaches a process for producing a refined mineral oil in a reaction vessel having two reaction zones and an intermediate zone, and with the hydrocarbon feed and hydrogen feed flowing in a countercurrent relationship with each other. The intermediate zone, intermediate between the two reaction zones, is disclosed as being useful for stripping the hydrogen sulfide formed in the first reaction zone from the hydrocarbon distillate. In the reaction zone below the intermediate zone, conversion reactions are maintained substantially free of sulfur and $H_2S$. As recognized by Kirk, one notable aspect of operating a hydroconversion zone with the hydrocarbon and hydrogen feeds in countercurrent flow is the stripping action of the hydrogen which removes hydrogen sulfide from the liquid phase in the reaction zone and/or intermediate zone. Thus, in the reaction zone near the hydrogen inlet under countercurrent flow conditions the liquid phase hydrocarbons, which are relatively free of sulfur, are hydroconverted over a catalyst relatively free of sulfur poisons in the presence of relatively pure hydrogen.

As hydrogen moves through a hydroconversion reaction zone in countercurrent flow to the hydrocarbon liquid phase, it also strips gaseous hydrocarbon products from the reacting liquid phase. In conventional hydroconversion processes, these gaseous products must be separated from the liquid products before they are further processed, at additional separation, compression, and reaction expense. In hydroconversion reaction systems with hydrocarbon and hydrogen flows in countercurrent relationship with each other, the processing equipment is much simplified and processing costs reduced.

U.S. Pat. No. 3,461,061, issued Aug. 12, 1969 to Stine, et.al. discloses a countercurrent reactor system, with a liquid phase heavy petroleum fraction passing downwardly through a reactor bed, and hydrogen rising upwardly in countercurrent contact with the petroleum fraction. The Stine process includes a second fixed bed catalytic reactor maintained under hydrogenating conditions through which a gaseous stream in vapor phase from the first reactor bed flows in a downward direction, cocurrent with added hydrogen.

However, in hydroconversion reaction processes with countercurrent flows of liquid and vapor phases, the vapor phase may sweep relatively unreacted feed components out the hydroconversion reaction zone before significant reaction occurs. Thus, GB 1,323,257, published Jul. 11, 1973 by Peck, et.al., discloses a hydrocarbon hydro-conversion process involving a reaction system with a heavy hydrocarbon charge stock flowing downward in a first reaction zone, and hydrogen flowing in the first catalyst zone countercurrent to the hydrocarbon stock, with conditions selected to maintain a lower-boiling hydrocarbon liquid derived from the charge stock in the second catalyst zone. U.S. Pat. No. 3,843,508, issued Oct. 22, 1974 to Wilson, et.al. discloses a similar process, with the additional feature that products from the reaction are additionally catalytically cracked.

However, selecting conditions to maintain a lower-boiling hydrocarbon liquid in the second catalyst zone puts severe limitations on the operation of that second zone. An improved process is much desired.

SUMMARY OF THE INVENTION

Accordingly, a process is presented for the substantial conversion of a hydrocarbon feedstock to lower boiling products by introducing the hydrocarbon feedstock to a first hydroconversion zone at superatmospheric pressure and at a temperature in the range of 450° F. to 850° F. in the presence of hydrogen, said hydrogen flowing in a countercurrent relationship to said hydrocarbon feedstock, to form a hydrogen-rich vapor effluent and a hydrocarbon-rich liquid effluent, reacting said hydrogen-rich vapor effluent in a second hydroconversion zone to form a converted vapor effluent, and introducing a portion of said hydrocarbon-rich liquid effluent to said second hydroconversion zone in countercurrent relationship to said hydrogen-rich vapor effluent.

The process of the present invention includes a hydroconversion reactor system comprising a first and a second hydroconversion reaction zone. In carrying out the process of this invention, the hydrocarbon feedstock is introduced in downward flow to the first hydroconversion zone, at a feed entry point below a second hydroconversion zone. We use the term "downward" to connote the preferred direction when the typically cylindrical reactors are oriented vertically, but it is recognized the reactors may be oriented horizontally, in which case downward will mean a first flow direction. Similarly, the term "upward" as used hereinbelow means opposite the flow direction termed "downward". Here a point "below" a reference point is based on the direction relative to the hydrogen flow, and represents a location past which the hydrogen flows prior to flowing past the reference point.

Hydrogen feed to the first hydroconversion zone is introduced in upward flow, with the hydrocarbon feed and hydrogen feed flowing in countercurrent relationship with each other. Preferably, the first and second hydroconversion reaction zones are contained in a single reactor vessel, with the second hydroconversion reaction zone positioned directly above and in direct liquid and vapor communication with the first hydroconversion reaction zone. Optionally, the first and second hydroconversion reaction zones may be present in separate reactor vessels, with a means for conducting the hydrogen-rich vapor effluent from the first hydroconversion reaction zone to the second hydroconversion reaction zone.

We have discovered that recycling a portion of the liquid effluent from the hydroconversion process to a second hydroconversion zone significantly improves the operation of the second reaction zone without imposing the limitations of the above mentioned processes of others.

During the course of the hydroconversion reactions in the first conversion zone, upwardly flowing hydrogen strips at least a portion of light hydrocarbons, ammonia, and hydrogen sulfide products from the downwardly flowing hydrocarbon feed. Consequently, when the hydrogen feed enters the second hydroconversion reaction zone, it is diluted by the light hydrocarbon reaction products stripped from the hydrocarbon feed. This hydrogen-rich vapor effluent comprising hydrogen and the light hydrocarbon reaction products undergo further hydroconversion reactions in the second hydroconversion zone.

It is also an important aspect of this invention that the hydrocarbon-rich liquid phase from the first hydroconversion reaction zone be separated in a first separation zone, and that a portion of the hydrocarbon-rich liquid phase be introduced in downward flow as a liquid recycle stream to the second hydroconversion zone, in countercurrent relationship with the hydrogen-rich vapor phase.

Preferably, the portion of the hydrocarbon-rich liquid phase which is recycled to the second hydroconversion zone comprises a heavy portion from a distillation separation of the hydrocarbon-rich liquid effluent.

Among other factors, we have found that by recycling to the second hydroconversion zone a stream having sufficiently high boiling range that it remains a liquid, a greater range of operating conditions are possible in the second hydroconversion zone, thus allowing for higher conversions and product yields.

Surprisingly, when in a preferred embodiment a liquid stream, such as one of the liquid fractions from the second separation zone is used to quench the first hydroconversion zone, a decrease in hydrogen recycle and associated expense may be realized, with no apparent negative effect on hydrocarbon conversion.

DETAILED DESCRIPTION OF THE INVENTION

Figure 1:
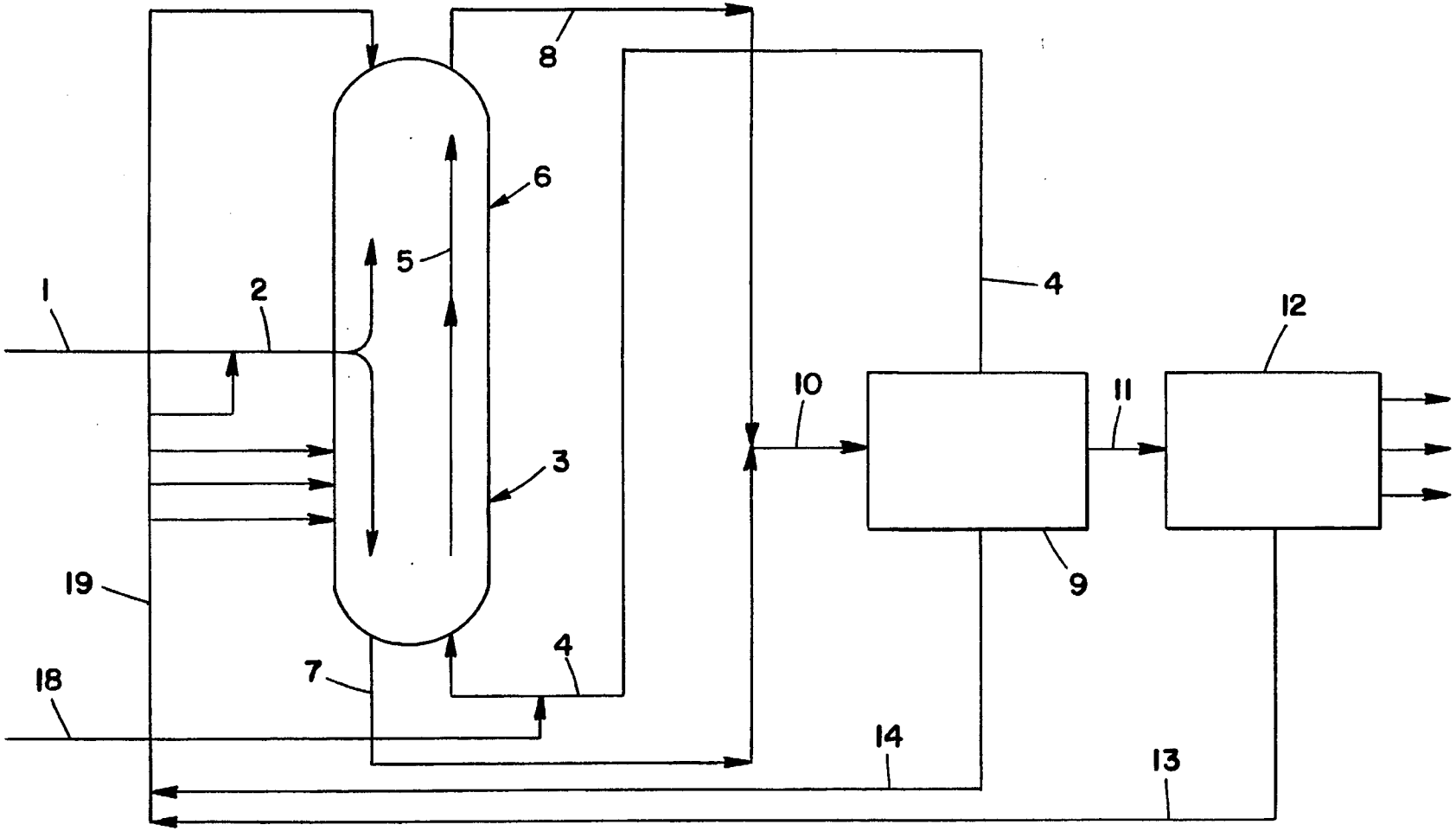
FIG. 1 is a flow schematic of the process of our invention depicting a first and a second hydroconversion zone, with flow directions indicated thereon.

The process of the present invention relates to catalytic hydroconversion of a hydrocarbon gas oil or residuum stream. More specifically, it relates to a catalytic hydroconversion process in which the hydrocarbon and hydrogen feeds flow through at least one reaction zone in a hydroconversion reaction system in countercurrent relationship to each other.

The term "hydroconversion" is used here to connote a process in which hydrogen is reacted with a hydrocarbon on the surface of a heterogeneous hydroconversion catalyst at conversion conditions. Example hydroconversion processes include hydrofining, hydrotreating and hydrocracking. As used herein the term "hydrocarbon" includes feedstocks such as heavy gas oil, reduced crude, vacuum distillation residua, or solvent deasphalted residua, which contain sulfur and/or nitrogen impurities.

When the above described process is used to hydrotreat feedstocks to remove sulfur and nitrogen impurities the following process conditions will typically be used: reaction temperature, 400°–850° F.; pressure, 500 to 5000 psig; LHSV, 0.5 to 20; and overall hydrogen consumption 250 to 2000 scf per barrel of liquid hydrocarbon feed. The hydrotreating catalyst for the beds will typically be a composite of a Group VI metal or compound thereof and/or a Group VIII metal or compound thereof supported on a porous refractory base such as alumina. Examples of hydrotreating catalysts are alumina supported cobalt-molybdena, nickel sulfide, tungsten-nickel sulfide, cobalt molybdate and nickel molybdate.

A hydroconversion process for which the process of this invention is particularly suited is that of hydrocracking. In hydrocracking a portion of the hydrocarbon feed is cracked to hydrocarbon products of lower boiling point, sulfur present in the feed is converted to hydrogen sulfide, and nitrogen in the feed is converted to ammonia. When the process is used to hydrocrack feedstocks the following operating conditions will normally prevail: reaction temperature, 400°–950°; reaction pressure 500–5000 psig; LHSV, 0.1 to 15; and hydrogen consumption 700–2500 scf per barrel of liquid hydrocarbon feed. The hydrocracking catalysts used for the beds will typically be a Group VI, Group VII, or Group VIII metal or oxides or sulfides thereof supported on a porous refractory base such as silica or alumina or a combination thereof, and may optionally contain crystalline molecular sieves or crystalline zeolite materials. Examples of hydrocracking catalysts are oxides or sulfides of Mo, W, V, and Cr supported on such bases.

In conventional hydroconversion processing, gaseous and light liquid reaction products are separated from the heavier liquid reaction products in a separation zone external to the reaction zone, and are further reacted as necessary in a reaction zone separate from the first reaction zone. In the process of this invention, the hydrogen flowing through a first reaction zone in countercurrent relationship with the downwardly flowing liquid hydrocarbon stream strips the light hydrocarbon products from the liquid hydrocarbon stream to form a hydrogen-rich vapor effluent stream. The separation of the light hydrocarbon products in the reaction zone decreases markedly the separation requirements of the reaction products external to the reaction zone. After leaving the first reaction zone, the vapor effluent stream passes to a second hydroconversion reaction zone, operated at reaction conditions and with a catalyst selected for the specific reactions desired. It is an important feature for this process that the hydrogen effectively strips the vapor reaction products from the flowing hydrocarbon liquid in the first reaction zone in order to reduce cost of additional separation, and to insure that the vapor product be available for reaction in the second hydroconversion reaction zone.

The hydrogen-rich vapor effluent leaving the first hydroconversion reaction zone, countercurrent to the incoming hydrocarbon liquid feed, tends to sweep a small portion of the relatively unreacted liquid hydrocarbon material from the top of the first hydroconversion reaction zone into the second hydroconversion reaction zone in the form of, for example, mist or droplets. In a vapor phase hydroconversion reaction zone, these droplets may be swept through the zone with minimal contact with the hydroconversion catalyst, and with minimal conversion. Previous efforts to control the loss of these finely divided particles of liquid feed have resorted to maintaining a liquid phase in the second hydroconversion reaction zone by selecting conditions to maintain a portion of the hydrogen-rich vapor effluent stream in the liquid phase. This puts severe limitations on the range of operating conditions of the second zone. We have found that these finely divided particles of liquid feed can be recovered by adding a liquid stream to the second hydroconversion zone. Thus, in the process of this invention, a liquid recycle stream is added to the second zone, said liquid recycle stream having a sufficiently high boiling range that it remains a liquid at the conditions of the second hydroconversion zone. Preferably, this liquid stream added to the second zone is a heavy distillate fraction prepared by a separation of the hydrocarbon-rich liquid phase effluent from the first hydroconversion reaction zone. More preferably, this liquid stream added to the second zone is prepared by separating a hydrocarbon-rich liquid effluent from the first hydroconversion reaction zone in a first separation zone, then by separating at least one of the liquid streams from the first separation zone in a second separation zone operated as a distillation column, and then by selecting one or more of the distillate streams from the second separation zone for recycle to the second hydroconversion reaction zone. Thus, the process of this invention provides a liquid recycle stream from a second separation zone to flow countercurrent to the flow of the hydrogen-rich vapor effluent to move the entrained feed droplets back into the first hydroconversion reaction zone. Providing a liquid reactant in the second hydroconversion reaction zone results in greater flexibility in selecting the operating conditions in the second hydroconversion reaction zone. The particular recycle liquid selected affords an opportunity for the refiner to further hydroprocess this liquid in the second reaction zone.

As stated above, in carrying out this invention, the hydrocarbon-rich liquid effluent from the first hydroconversion reaction zone is separated in a first separation zone into at least one liquid phase stream and at least one vapor phase stream comprising hydrogen. This separation may include hot separation at high pressure and cold separation at low pressure, with the designed purpose of recovering a maximum of the unreacted hydrogen in relatively pure form for recycle to the first hydroconversion reaction zone. The liquid phase effluent from the first separation zone is then separated into one or more liquid phases of narrower boiling range in a second separation zone, one of which liquid phases may be recycled to the second hydroconversion reaction zone and/or to the hydrocarbon feed to the first hydroconversion reaction zone and/or to one or more locations along the length of the first hydroconversion reaction zone. It is one of the advantages of the process scheme of this invention, with liquid hydrocarbon and hydrogen flowing in countercurrent relationship with each other, that a liquid stream, such as one of the liquid fractions from the second separation zone, may be used as a quench stream in the first hydroconversion reaction zone, to help maintain the reaction temperature within the zone. Further, this process provides a reduced need for the recirculation of a quench gas.

In another embodiment of this invention, the hydrocarbon-rich liquid effluent from the first hydroconversion reaction zone is further treated in a liquid effluent hydrotreater. The liquid effluent hydrotreater may be present in a separate reactor, or it may be a reaction zone within the reactor which contains the first hydroconversion reaction zone. The reaction pressure in the liquid effluent hydrotreater will be essentially equal to that of the first hydroconversion reaction zone, accounting for any hydraulic losses due to flow between the two zones. The reaction temperature in the liquid effluent hydrotreater will preferably be higher than that in the first hydroconversion reaction zone, to desaturate and avoid hydrogen give-away. Since the hydrocarbon liquid passing from the first hydroconversion reaction zone to the liquid effluent hydrotreater will contain only small amounts of sulfur, the catalysts chosen for the hydrotreater may be those which catalyze hydrogenation reactions, such as aromatic saturation, but which may be sensitive to the present of sulfur compounds in the feed, such as noble metal catalysts, and preferably platinum- and palladium-containing catalysts.

In yet a further embodiment of this invention, a vapor phase hydrotreater is included for treating the converted vapor effluent from the second hydroconversion reaction zone, without any liquid present, using a hydroconversion catalyst selected from those known to those skilled in the art of hydroconversion. The reaction conditions in the vapor phase hydrotreater will be similar to those of the second hydroconversion reaction zone, considering any temperature and pressure differentials between the two zones.

Referring now to FIG. 1, in accordance with the present invention a hydrocarbon feed is introduced to the process in line 1 (the feed is typically heated in a furnace, not shown) through the feed inlet point 2 into the first hydroconversion reaction zone 3 in downward liquid phase flow. Gaseous and some light liquid materials in the feed stream will flow upward in a direction opposite that of the liquid. A recycle vapor stream 4 comprising hydrogen with lesser amounts of light hydrocarbon gases, ammonia, and hydrogen sulfide combined with a make-up hydrogen stream 18 enters near the lower end of the first hydroconversion reaction zone 3 and flows upward in countercurrent relationship to the liquid phase. As the liquid phase hydrocarbon feed is treated under hydroconversion conditions, reaction products including hydrocarbon vapors, $H_2S$ and $NH_3$ are produced. An amount of these reaction products are stripped from the liquid phase by the countercurrent hydrogen flow to form a hydrogen-rich vapor effluent 5. The hydrogen-rich vapor effluent 5 from reaction zone 3 passes the feed entry point 2 and enters the second hydroconversion reaction zone 6, operated at hydroconversion reaction conditions to produce a converted vapor effluent 8.

The hydrocarbon-rich liquid effluent 7 from the first hydroconversion reaction zone 3 is combined with the converted vapor effluent 8 from the second hydroconversion reaction zone to form a combined effluent 10, which is sent to a first separation zone 9 for recovery of the unreacted hydrogen from the combined effluent 10. A liquid phase effluent stream 11 from the first separation zone is further separated in a second separation zone 12. A portion of recycle stream 13 from the second separation zone is introduced to the second hydroconversion zone 6, in countercurrent flow to the hydrogen-rich vapor stream 5. A portion of stream 13 is also optionally added to the hydrocarbon feed in line 1. Further, a portion of recycle stream 13 is optionally added at one or more locations along the length of hydroconversion reaction zone 3 as interbed quench to reduce or eliminate the need for quench gas and thereby reduce line and vessel sizes. This has the additional advantage that, in the countercurrent flow scheme, the quench recycle liquid flows through the reaction zones for additional processing.

Figure 2:
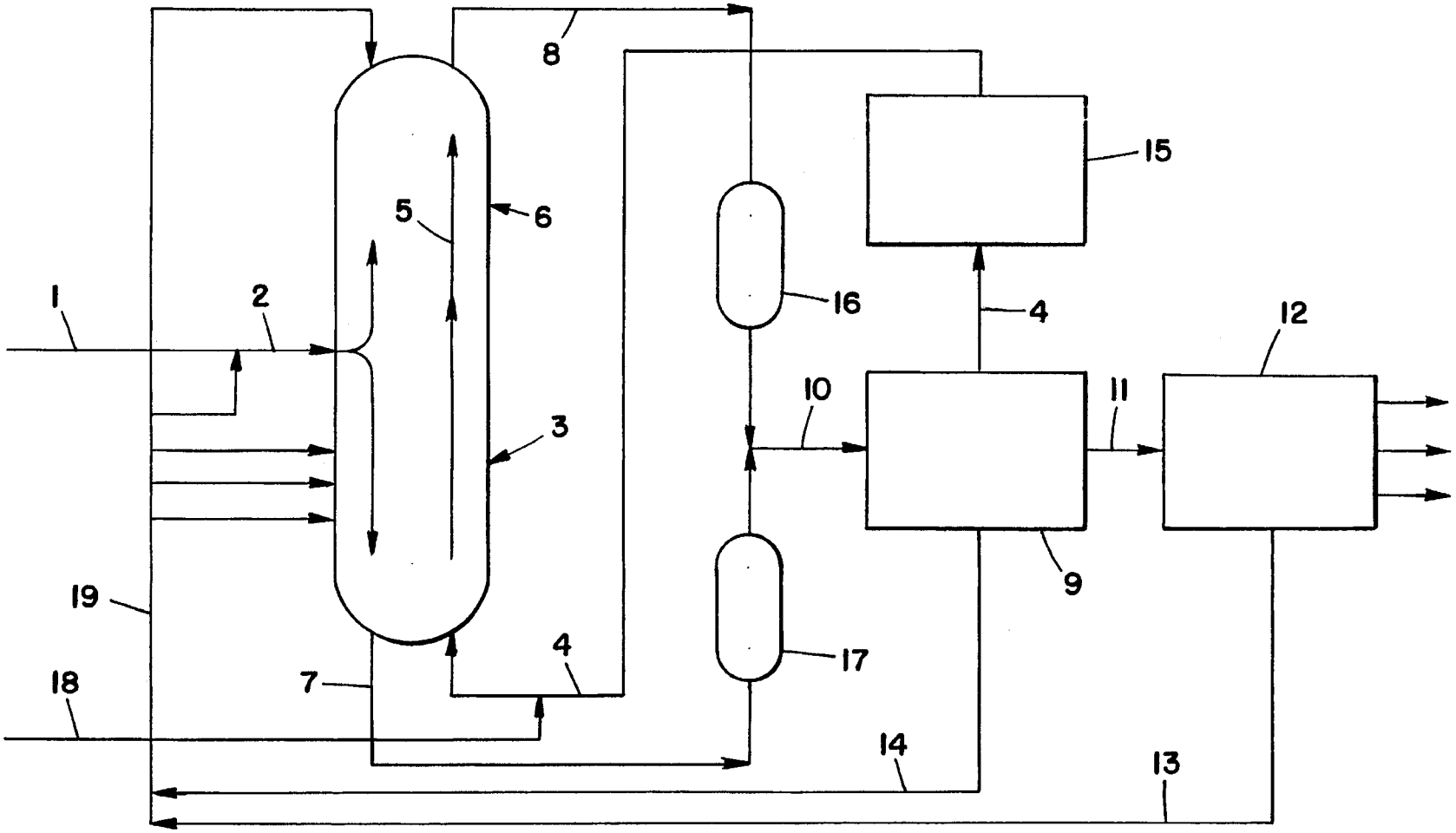
FIG. 2 depicts further embodiments of the process of our invention, which variously include a vapor phase hydrotreater, a liquid effluent hydrotreating zone, and an optional hydrogen purification zone.

Referring now to FIG. 2, within the process of this invention, the first separation zone 9 produces at least a liquid phase effluent 11 and a recycle vapor phase 4 comprising hydrogen. In most cases, the hydrogen purity in stream 4 is sufficiently pure for recycle to the first hydroconversion reaction zone 3. However, it is optionally beneficial to further purify the recycle vapor phase in a hydrogen purification zone 15, using, for example, pressure swing absorption or membrane separation. The first separation zone 9 may also produce a hot high pressure effluent stream 14 for recirculation to the second hydroconversion reaction zone 6 in countercurrent flow with the hydrogen-rich vapor stream 5. Stream 14 may also be recirculated to the hydrocarbon feed in line 1, and at one or more locations along the length of the first hydroconversion reaction zone 3.

In another embodiment of this invention, the hydrocarbon-rich liquid stream 7 is further hydroconverted in a liquid effluent hydrotreater zone 17, which may be in a separate reactor or present as a zone in the reactor vessel containing the first hydroconversion reaction zone 3. Having a hydrocarbon product stream 7 relatively free of hydrogen sulfide and other sulfur containing materials allows the use a catalyst in reaction zone 17 that may be less resistant to the poisoning effects of $H_2S$, for example, noble metal catalysts. The liquid effluent hydrotreater is useful for liquid hydrotreating, such as for the reduction of normal paraffins to improve diesel and bottoms pour points and kerosene freeze points and for aromatic saturation.

In yet another embodiment of this invention, a vapor phase hydrotreater 16 is included for treating the converted vapor effluent 8 from the second hydroconversion zone in vapor phase operation with a hydroconversion catalyst and at lower temperature than that of the second hydroconversion reaction zone.

What is claimed is:

1. A process for converting a hydrocarbon feedstock comprising the steps of:

(a) introducing the hydrocarbon feedstock to a first hydroconversion zone in the presence of hydrogen, the hydrogen flowing in a countercurrent relationship to the hydrocarbon feedstock, to form a hydrogen-rich vapor effluent and a hydrocarbon-rich liquid effluent;

(b) reacting the hydrogen-rich vapor effluent in a second hydroconversion zone to form a converted vapor effluent; and (c) introducing a recycle stream comprising a portion of the hydrocarbon-rich liquid effluent from the first hydroconversion zone to the second hydroconversion zone in countercurrent relationship to the hydrogen-rich vapor effluent; and wherein said first and second hydroconversion zones are conducted at a temperature of 400° to 850° F. and a pressure of 500 to 5000 psig.

2. The process of claim 1 further comprising recycling a portion of the hydrocarbon-rich liquid effluent to the hydrocarbon feedstock.

3. The process of claim 2 further comprising introducing the converted vapor effluent to a third hydrocarbon conversion zone maintained at a temperature lower than the temperature of the second hydrocarbon conversion zone.

4. A process for converting a hydrocarbon feedstock comprising the steps of:

(a) introducing the hydrocarbon feedstock to a first hydroconversion zone at superatmospheric pressure and at a temperature in the range of 450° F. to 850° F. in the presence of hydrogen, the hydrogen flowing in a countercurrent relationship to the hydrocarbon feedstock, to form a hydrogen-rich vapor effluent and a hydrocarbon-rich liquid effluent;

(b) separating the hydrocarbon-rich liquid effluent at essentially the pressure and at essentially the temperature of the first conversion zone to produce a recycle stream;

(c) reacting the hydrogen-rich vapor effluent in a second hydroconversion zone to form a converted vapor effluent; and (d) introducing at least a portion of the recycle stream comprising a portion of the hydrocarbon-rich liquid effluent from the first hydroconversion zone to the second hydroconversion zone in countercurrent relationship to the hydrogen-rich vapor effluent; and wherein said first and second hydroconversion zones are conducted at a temperature of 450° to 850° F. and a pressure of 500 to 5000 psig.

5. The process of claim 2 further comprising introducing a portion of the hydrocarbon-rich liquid effluent at one or more locations along the length of the first conversion zone.

6. The process of claim 4 further comprising introducing a portion of the recycle stream at one or more locations along the length of the first conversion zone.

7. The process of claim 1 wherein the first conversion zone contains catalysts which comprise one or more metallic elements selected from the group consisting of nickel, cobalt, molybdenum, and tungsten.

8. The process of claim 1 further comprising introducing the hydrocarbon-rich liquid effluent into a liquid effluent hydrotreater in the presence of added hydrogen.

9. The process of claim 8 wherein the liquid effluent hydrotreater contains catalysts comprising one or more noble metal elements.

10. The process of claim 9 wherein the noble metal elements are selected from the group consisting of platinum and palladium.

11. The process of claim 1 further comprising introducing at least a portion of the converted vapor effluent to a vapor phase hydrotreater operated at a temperature lower than the reaction temperature of the second hydroconversion reaction zone.

12. A process for hydrocracking a hydrocarbon feedstock comprising the steps of:

a) introducing the hydrocarbon feedstock to a first hydroconversion zone in the presence of hydrogen, the hydrogen flowing in a countercurrent relationship to the hydrocarbon feedstock to form a hydrogen-rich vapor effluent and a hydrocarbon-rich liquid effluent;

b) reacting the hydrogen-rich vapor effluent in a second hydroconversion zone to form a converted vapor effluent; and c) introducing a recycle stream comprising a portion of the hydrocarbon-rich liquid effluent from the first hydroconversion zone to the second hydroconversion zone in countercurrent relationship to the hydrogen-rich vapor effluent; and wherein said first and second hydroconversion zones are conducted at a temperature of 400° to 950° F. and a pressure of 500 to 5000 psig.

* * * * *